US011391448B2

(12) United States Patent
Huang et al.

(10) Patent No.: US 11,391,448 B2
(45) **Date of Patent: *Jul. 19, 2022**

(54) DOWNLIGHT APPARATUS

(71) Applicant: XIAMEN ECO LIGHTING CO. LTD., Xiamen (CN)

(72) Inventors: ZhenKun Huang, Xiamen (CN); Maojin Zeng, Xiamen (CN); Qiqing Yu, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/031,599

(22) Filed: Sep. 24, 2020

(65) Prior Publication Data

US 2021/0010661 A1 Jan. 14, 2021

Related U.S. Application Data

(63) Continuation of application No. 15/894,891, filed on Feb. 12, 2018, now Pat. No. 10,816,171.

(30) Foreign Application Priority Data

Sep. 26, 2017 (CN) ..... 201710882499.7
Dec. 14, 2017 (CN) ..... 201721742905.1

(51) Int. Cl.

| | |
|---|---|
| ***F21V 21/04*** | (2006.01) |
| ***F21S 8/02*** | (2006.01) |
| ***F21V 21/14*** | (2006.01) |
| ***F21V 29/70*** | (2015.01) |
| ***F21V 7/04*** | (2006.01) |
| *F21Y 115/10* | (2016.01) |

(52) U.S. Cl.

CPC ..... *F21V 21/047* (2013.01); *F21S 8/026* (2013.01); *F21V 7/04* (2013.01); *F21V 21/14* (2013.01); *F21V 29/70* (2015.01); *F21Y 2115/10* (2016.08)

(58) Field of Classification Search

CPC ..... F21V 21/047; F21V 7/04; F21V 29/70; F21V 21/14; F21S 8/026; F21Y 2115/10

See application file for complete search history.

(56) References Cited

U.S. PATENT DOCUMENTS 10,816,171 B2 * 10/2020 Huang ..... F21V 7/04
2013/0201697 A1 * 8/2013 Osada ..... F21K 9/20 362/373

* cited by examiner

*Primary Examiner* — Kevin Quarterman
(74) *Attorney, Agent, or Firm* — Chun-Ming Shih; Lanway IPR Services

(57) ABSTRACT

A downlight apparatus is designed to be installed in a cavity of a ceiling. The downlight apparatus includes a base part, a major part and a connector. The base part has a shape to be fixed in the cavity of the ceiling. The base part has a base housing for defining a through hole and a light window. The major part includes a major housing, a light source and a driver circuit. The connector connects the major housing and the base housing. The connector provides multiple candidate positions for a user to configure to change a relative position of the base part and the major part so as to change an output light defined determined by the light window and the light source.

10 Claims, 9 Drawing Sheets

DOWNLIGHT APPARATUS

RELATED APPLICATION

The present application is a continued application of U.S. patent Ser. No. 15/894,891.

FIELD OF THE INVENTION

The present invention is related to a downlight apparatus and more particularly related to a LED downlight apparatus.

BACKGROUND

Downlight apparatuses are widely used in our daily life. Downlight apparatuses are usually installed in a cavity in a ceiling for emitting light downwardly. In some countries, there is a standard connection box pre-installed in the ceiling so that users may install their downlight apparatuses into the connection box. In some other countries, downlight apparatuses are installed in a cavity of a ceiling.

There are various issues to be considered when designing a downlight product. For example, heat dissipation, luminance efficacy and cost are some of the major design issues. Along with advancement of technology, LED and various new features are gradually introduced in market products, and also increase human expectation of next generation of downlight products.

In such crowded field, it is very beneficial to find out innovative design that may satisfy human needs more perfectly.

SUMMARY OF INVENTION

According to an embodiment, a downlight apparatus is designed to be installed in a cavity of a ceiling. The downlight apparatus includes a base part, a major part and a connector. The base part has a shape to be fixed in the cavity of the ceiling. The base part has a base housing for defining a through hole and a light window. The major part includes a major housing, a light source and a driver circuit. The connector connects the major housing and the base housing. The connector provides multiple candidate positions for a user to configure to change a relative position of the base part and the major part so as to change an output light defined determined by the light window and the light source.

For example, when the light window is a circle facing outwardly, the light beam angle may be adjusted by changing the relative position between the major part which carries the light source and the base part which defines where the light window is. Specifically, when the light source has longer distance from the light window, the light beam angle may be narrower. On the other hand, when the light source is moved closer to the light window, the light beam angle may be wider.

There are various ways to implement this embodiments and some of their variations, for explanation not to limit the inventive scopes, are explained as follows.

First, the light source may be LED modules mounted on a light source board with SMD (Surface Mounted Device), COB (Chip on Board), CSP (Chip Scale Packaging) or other packaging methods. In addition, the LED modules may be arranged in a surrounding wall, facing to a light guide which guides input light to bottom surface.

Lens and reflector may be installed in the major part or in the base part. There may be a ring cover with a light window in the middle for the output light to be emitted therefrom.

In some embodiments, the connector includes a track disposed on the base part and a fastener disposed on the major part. The relative position of the fastener to the track is adjustable when applying an external force and remained the relative position unchanged when the external force disappears. In other words, the downlight apparatus is mainly a two-piece components, i.e. the major part and the base part. The connector may be a third independent piece or parts of the major part or the base part.

In one example, the track is an inverted U gate with two bars with grooves for connecting to the fastener. The two bars have sliding grooves so that the fastener may be moved along the groove. There may be a connecting top bar for connecting the two bars with grooves. The top bar and the two bars may be made as a metal piece, for helping heat dissipation and connecting the components at the same time.

In some embodiments, the fastener includes two fastener units with a flexible component to engage with the groove with an elastic force so as to keep the fastener units to remain at original positions if no external force is applied on moving the major part in relative to the base part.

Please be noted that three or more fasteners may be used to further increase overall robustness of the downlight product.

In some embodiments, the grooves has a limiter to prevent the major part apart from the base part. For example, the grooves has an end place where users cannot move further to prevent the major part apart from the base part, which may cause safety issues, e.g. the major part falling down from the ceiling.

In some embodiments, the track is built together with the major housing as a single unit. In other words, if the base housing is mainly made by molded plastic, the track may be designed and build in the same molding process. This may further decrease the overall cost and increase robustness of the product.

In some embodiments, the fastener has an adjusting screw to loosen or fasten connection between the fastener and the track. In other words, users may loosen the adjusting screw to move the major part with respect to the base part. After the adjustment is finished, the screw may be operated to tighten the connection between the base part and the major part.

In some embodiments, the track is provided with a ruler marks, indicating a length mark or a corresponding standard, e.g. EU, USA, Japan, for users to be easier to determine where is the desired relative position of the base part and the major part. This is particularly helpful for people who need to install lots of downlights with several desired relative positions.

In some embodiments, the fastener may include one or more balls pressed with an elastic unit to fit in one of multiple candidate holes in the track. For example, a spring or an elastic clip may be used to press the ball in one of several candidate holes. Users may move the ball to a next candidate hole by pressing an external force and when the external force is released, the major part stays at that relative position with respect to the base part.

Please be noted that ball refers to ball structures and any equivalent units may be applied to perform the same way, function, and result, which may still be regarded as the invention.

In some embodiments, the adjustment of the relative position between the major part and the base part is made before a downlight apparatus is installed in a ceiling. After the downlight apparatus is installed, users may not be able to change the relative position between the major part and the base part. In such case, the connector is hidden behind the major part.

In some other embodiments, the major part may has a pulling unit or similar unit connected to the major housing for a user to pull the major part to change the relative position between the major part and the base part. A triggering lever may trigger a lock structure to unlock to start adjustment of the relative position of the major part and the base part. After the adjustment is done, the pulling unit may be operated again to lock the relative position between the base part and the major part.

In some embodiments, the light source generates massive heat and the connector is made of heat conductive material for transmit heat from the major part to the base part to further enhance heat dissipation. For example, the connector is made of metal material.

In some embodiment, an output beam angle of the output light is changed by adjusting the relative position. In some designs, certain light may be cut and reflected to change the light beam angle.

To optimize luminous efficacy, a downlight usually has one or more light guiding or reflecting components made of various material. When such downlight apparatus may be adjusted by changing the relative position between the major part and the base part, the reflecting components may be designed to meet best luminous efficacy, e.g. having more than one set of reflecting curve surfaces to fit different corresponding relative positions between the base part and the major part.

For example, the base part has a reflective cup for reflecting a light from the light source to form the output light. The surface curve is optimized for at least two relative positions between the major part and the base part.

In some embodiments, the major part and the base part are adjusted by changing their relative position in one dimension, e.g. to keep the major part lower or higher with respect to the base part.

In some other embodiments, the major part may also be adjusted with a relative position with respect to the base part in more than one dimension, e.g. the major part may be bent with respect to the base part, to change light direction to the light window, which may be very helpful when installing a downlight to a specific target direction. For example, downlight apparatuses near a wall may be adjusted to change its light direction to far away from the wall or closer to the wall, depending on light environment design needs.

In some embodiments, the track may be placed in the major part, not the base part and the fastener may be changed its location, too. In other words, the relative placement of units may be exchanged and still fall in the invention scope.

In some embodiments, the fastener may use an elastic component to firmly attach to the track. In some other embodiments, the fastener may be adjusted by using screw or equivalent components to loosen or to fasten with respect the track.

In some embodiments, the adjustment of the relative position between the major part and the base part changes an overall height of the downlight apparatus.

In some embodiments, the overall height of the downlight apparatus is adjustable to fit different standard heights for different countries. Therefore, it is convenient for manufacturers or users to change to desired arrangement of the downlight apparatus.

DETAILED DESCRIPTION

Figure 1:
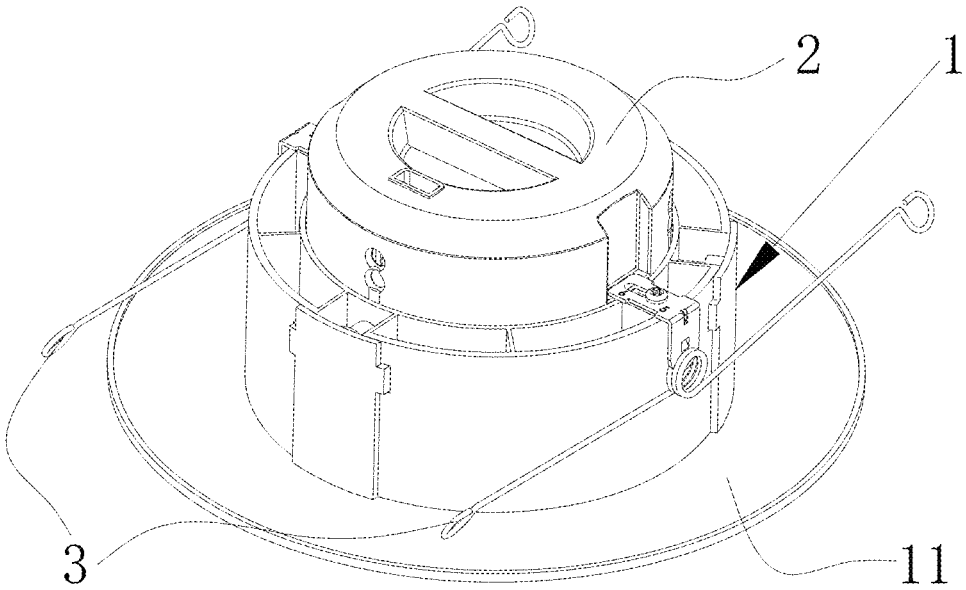
FIG. 1 illustrates an embodiment of a downlight apparatus.
Figure 2:
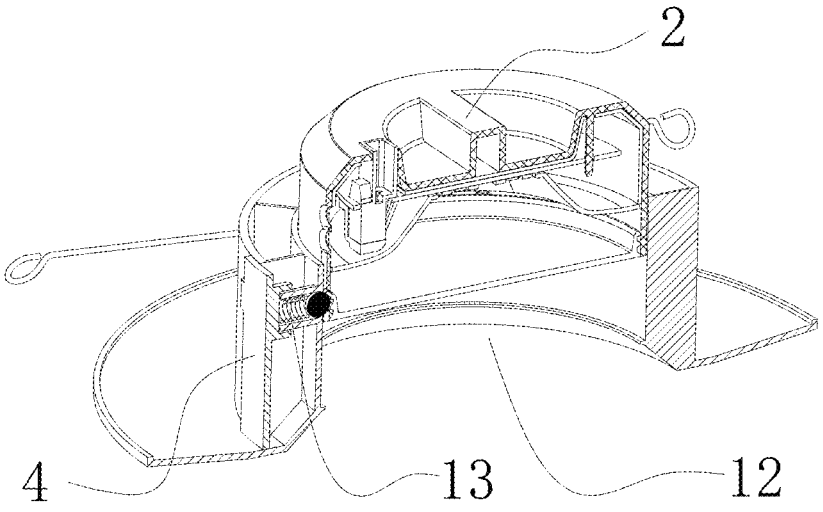
FIG. 2 illustrates a cross sectional view of the embodiment of FIG. 1

According to an embodiment, a downlight apparatus is designed to be installed in a cavity of a ceiling. The downlight apparatus includes a base part, a major part and a connector. The base part has a shape to be fixed in the cavity of the ceiling. The base part has a base housing for defining a through hole and a light window. The major part includes a major housing, a light source and a driver circuit. The connector connects the major housing and the base housing. The connector provides multiple candidate positions for a user to configure to change a relative position of the base part and the major part so as to change an output light defined determined by the light window and the light source.

For example, when the light window is a circle facing outwardly, the light beam angle may be adjusted by changing the relative position between the major part which carries the light source and the base part which defines where the light window is. Specifically, when the light source has longer distance from the light window, the light beam angle may be narrower. On the other hand, when the light source is moved closer to the light window, the light beam angle may be wider.

There are various ways to implement this embodiments and some of their variations, for explanation not to limit the inventive scopes, are explained as follows.

First, the light source may be LED modules mounted on a light source board with SMD (Surface Mounted Device), COB (Chip on Board), CSP (Chip Scale Packaging) or other packaging methods. In addition, the LED modules may be arranged in a surrounding wall, facing to a light guide which guides input light to bottom surface.

Lens and reflector may be installed in the major part or in the base part. There may be a ring cover with a light window in the middle for the output light to be emitted therefrom.

In some embodiments, the connector includes a track disposed on the base part and a fastener disposed on the major part. The relative position of the fastener to the track is adjustable when applying an external force and remained the relative position unchanged when the external force disappears. In other words, the downlight apparatus is mainly a two-piece components, i.e. the major part and the base part. The connector may be a third independent piece or parts of the major part or the base part.

In one example, the track is an inverted U gate with two bars with grooves for connecting to the fastener. The two bars have sliding grooves so that the fastener may be moved along the groove. There may be a connecting top bar for connecting the two bars with grooves. The top bar and the two bars may be made as a metal piece, for helping heat dissipation and connecting the components at the same time.

In some embodiments, the fastener includes two fastener units with a flexible component to engage with the groove with an elastic force so as to keep the fastener units to remain at original positions if no external force is applied on moving the major part in relative to the base part.

Please be noted that three or more fasteners may be used to further increase overall robustness of the downlight product.

In some embodiments, the grooves has a limiter to prevent the major part apart from the base part. For example, the grooves has an end place where users cannot move further to prevent the major part apart from the base part, which may cause safety issues, e.g. the major part falling down from the ceiling.

In some embodiments, the track is built together with the major housing as a single unit. In other words, if the base housing is mainly made by molded plastic, the track may be designed and build in the same molding process. This may further decrease the overall cost and increase robustness of the product.

In some embodiments, the fastener has an adjusting screw to loosen or fasten connection between the fastener and the track. In other words, users may loosen the adjusting screw to move the major part with respect to the base part. After the adjustment is finished, the screw may be operated to tighten the connection between the base part and the major part.

In some embodiments, the track is provided with a ruler marks, indicating a length mark or a corresponding standard, e.g. EU, USA, Japan, for users to be easier to determine where is the desired relative position of the base part and the major part. This is particularly helpful for people who need to install lots of downlights with several desired relative positions.

In some embodiments, the fastener may include one or more balls pressed with an elastic unit to fit in one of multiple candidate holes in the track. For example, a spring or an elastic clip may be used to press the ball in one of several candidate holes. Users may move the ball to a next candidate hole by pressing an external force and when the external force is released, the major part stays at that relative position with respect to the base part.

Please be noted that ball refers to ball structures and any equivalent units may be applied to perform the same way, function, and result, which may still be regarded as the invention.

In some embodiments, the adjustment of the relative position between the major part and the base part is made before a downlight apparatus is installed in a ceiling. After the downlight apparatus is installed, users may not be able to change the relative position between the major part and the base part. In such case, the connector is hidden behind the major part.

In some other embodiments, the major part may has a pulling unit or similar unit connected to the major housing for a user to pull the major part to change the relative position between the major part and the base part. A triggering lever may trigger a lock structure to unlock to start adjustment of the relative position of the major part and the base part. After the adjustment is done, the pulling unit may be operated again to lock the relative position between the base part and the major part.

In some embodiments, the light source generates massive heat and the connector is made of heat conductive material for transmit heat from the major part to the base part to further enhance heat dissipation. For example, the connector is made of metal material.

In some embodiment, an output beam angle of the output light is changed by adjusting the relative position. In some designs, certain light may be cut and reflected to change the light beam angle.

To optimize luminous efficacy, a downlight usually has one or more light guiding or reflecting components made of various material. When such downlight apparatus may be adjusted by changing the relative position between the major part and the base part, the reflecting components may be designed to meet best luminous efficacy, e.g. having more than one set of reflecting curve surfaces to fit different corresponding relative positions between the base part and the major part.

For example, the base part has a reflective cup for reflecting a light from the light source to form the output light. The surface curve is optimized for at least two relative positions between the major part and the base part.

In some embodiments, the major part and the base part are adjusted by changing their relative position in one dimension, e.g. to keep the major part lower or higher with respect to the base part.

In some other embodiments, the major part may also be adjusted with a relative position with respect to the base part in more than one dimension, e.g. the major part may be bent with respect to the base part, to change light direction to the light window, which may be very helpful when installing a downlight to a specific target direction. For example, downlight apparatuses near a wall may be adjusted to change its light direction to far away from the wall or closer to the wall, depending on light environment design needs.

In some embodiments, the track may be placed in the major part, not the base part and the fastener may be changed its location, too. In other words, the relative placement of units may be exchanged and still fall in the invention scope.

In some embodiments, the fastener may use an elastic component to firmly attach to the track. In some other embodiments, the fastener may be adjusted by using screw or equivalent components to loosen or to fasten with respect the track.

In some embodiments, the adjustment of the relative position between the major part and the base part changes an overall height of the downlight apparatus.

In some embodiments, the overall height of the downlight apparatus is adjustable to fit different standard heights for different countries. Therefore, it is convenient for manufacturers or users to change to desired arrangement of the downlight apparatus.

Please refer to FIG. 1 to FIG. 5.

The downlight apparatus has a base part 1 made of plastic or mixed with other material. Two spring clips 3 installed at two sides of the base part 1. The base part 1 has a ring part 11 defining a light window 12 for the light of the major part 2 to emit outside.

A fastener 13 is provided corresponding to a track 4 forming a connector for connecting the base part 1 and the major part 2. The major part 2 may be adjusted with its relative position with the base part 1.

Figure 3:
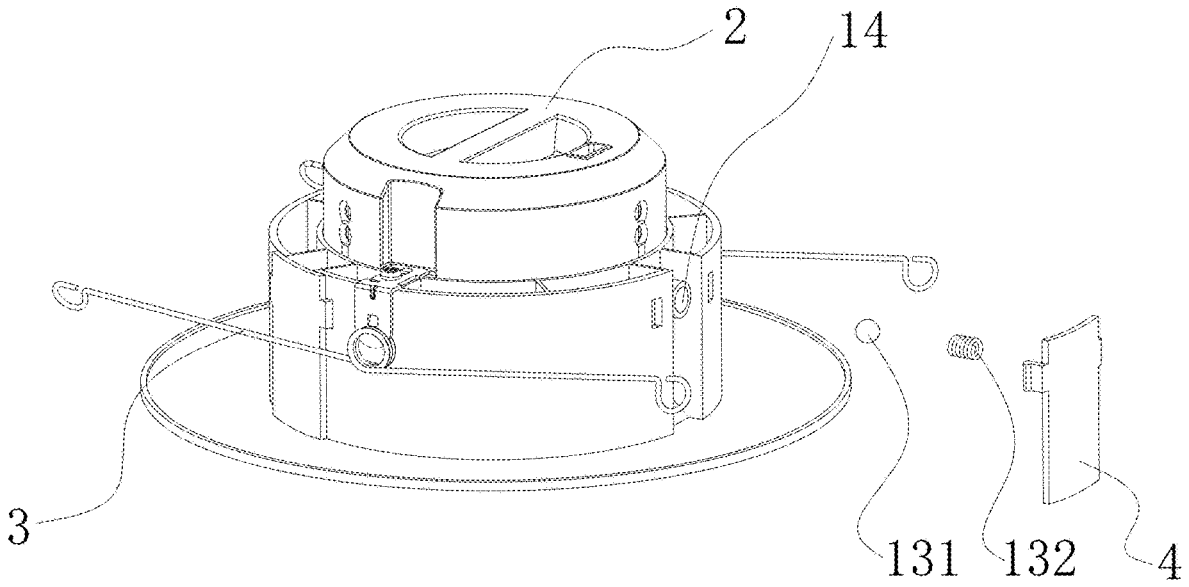
FIG. 3 illustrates a component explosive diagram of the embodiment.

In FIG. 3, it is illustrated that the fastener includes a ball 131, a spring 132 and a fixer 4. There are corresponding holes 14 disposed on a track which defines several candidate relative positions to be fit in, where the ball will stay without external force.

Figure 4:
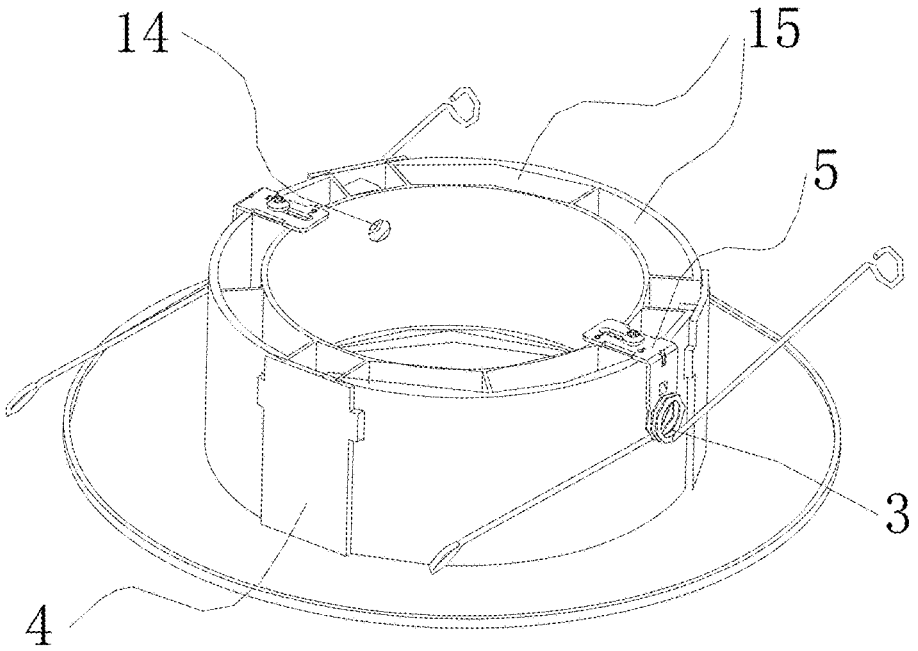
FIG. 4 illustrates another diagram of a partial component of the embodiment.

In FIG. 4, some structure holes 15 are provided to further save material cost while keeping robustness. An installation structure 5 is used for connecting the spring 3 which may be used for fixing the downlight apparatus in a cavity or a box in a ceiling.

Figure 5:
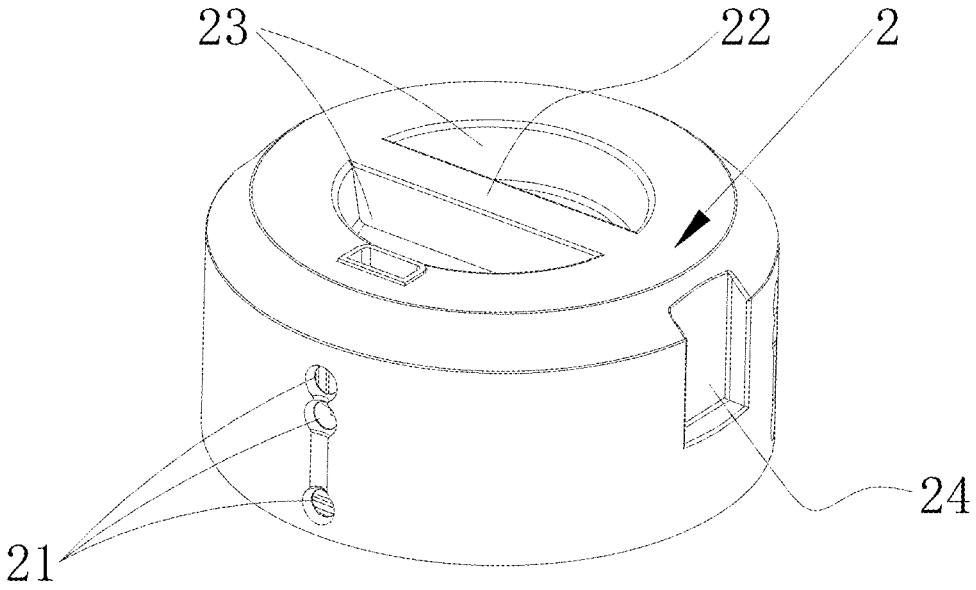
FIG. 5 illustrates the major part of the embodiment.

In FIG. 5, the major part may have several grooves 23, holding structure 22, preserved groove 24.

With such design, the downlight apparatus may be adjusted for the relative position of a major part and a base part.

Figure 6A:
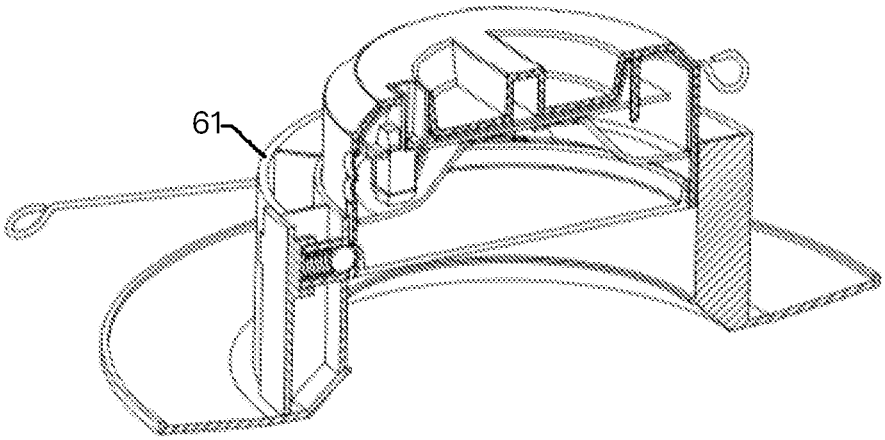
FIG. 6A, FIG. 6B and FIG. 6C illustrate three different relative positions between the major part and the base part.
Figure 6B:
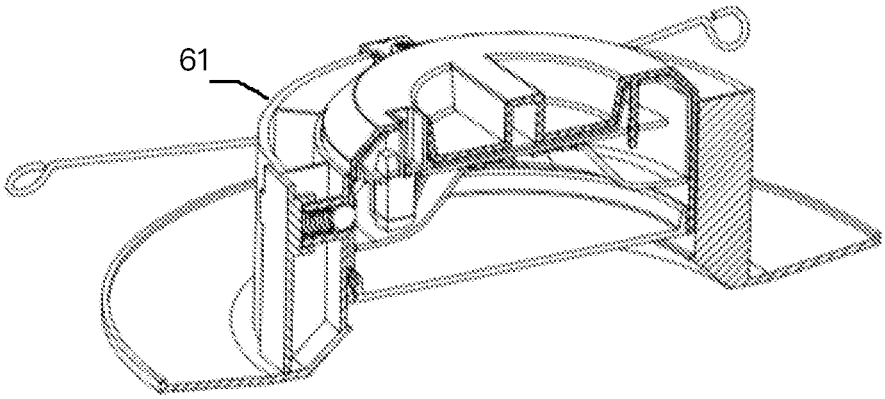
Figure 6C:
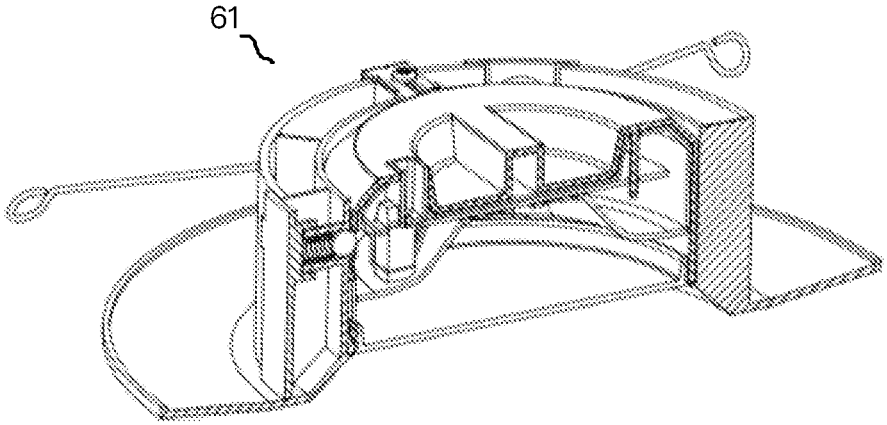

FIG. 6A, FIG. 6B and FIG. 6C illustrate three clear adjustment between the major part and the base part.

The downlight apparatus 61 may have three modes in this example. It is clearly to see how a ball stays in a corresponding hole in each status to keep the major part with a different desired relative position from the base part.

Figure 7A:
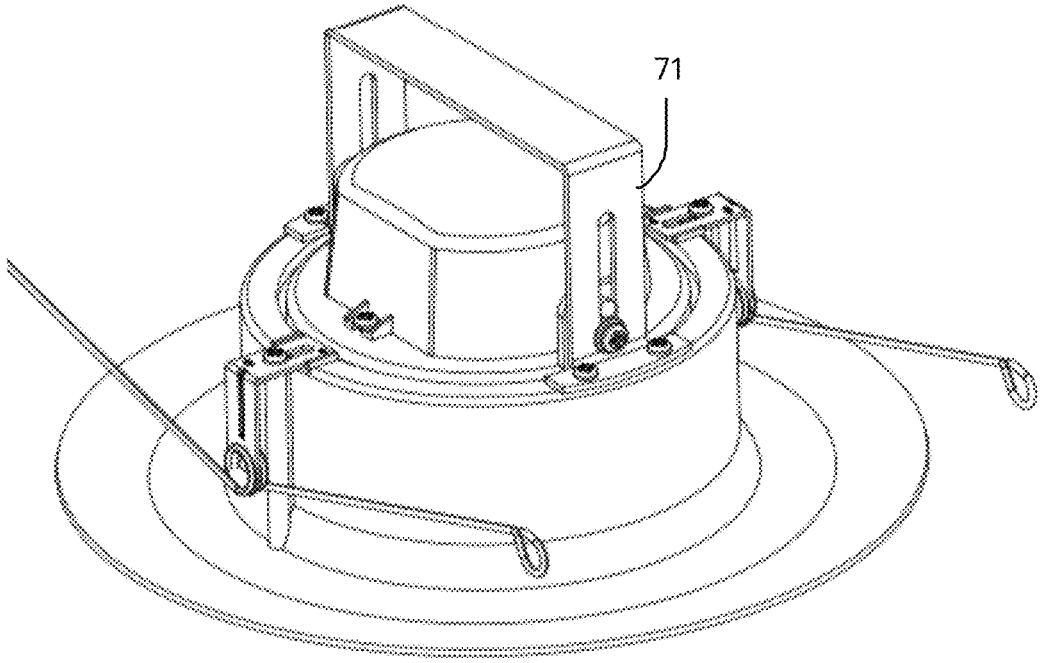
FIG. 7A and FIG. 7B illustrate two additional operation modes of an embodiment.
Figure 7B:
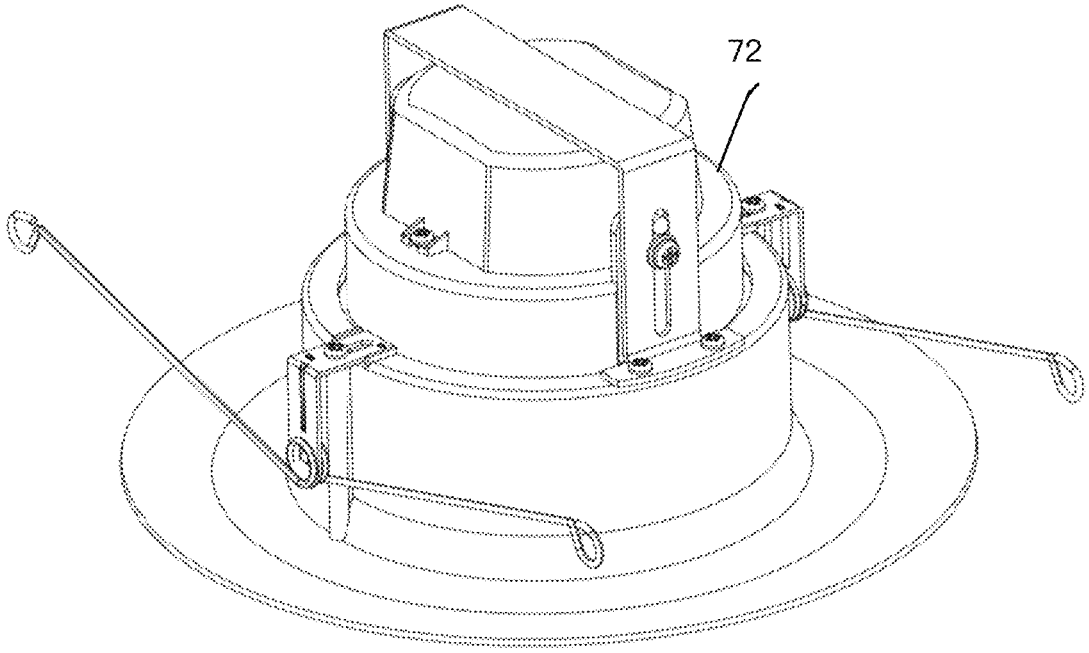

FIG. 7A and FIG. 7B illustrate another embodiment, not using ball structure as the fastener design.

In FIG. 7A, the first status keeps the downlight apparatus 71 having a first relative position between its major part and its base part. In FIG. 7B, the second status keeps the downlight apparatus 72 having a second relative position between its major part and its base part. In these two statuses, the light source has different distance from the light window and may provide different light beam angles based on such adjustment.

Figure 8:
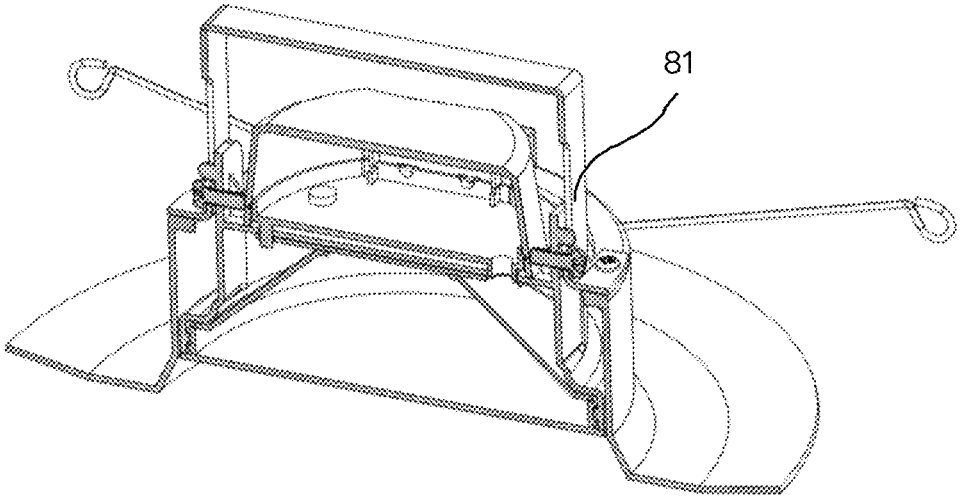
FIG. 8 is a cross sectional diagram of an embodiment.

FIG. 8 is a cross-sectional view of a downlight apparatus 81, in which it is clearly to seen how a fastener and a track form a connector for connecting a major part and a base part of a downlight apparatus.

Figure 9:
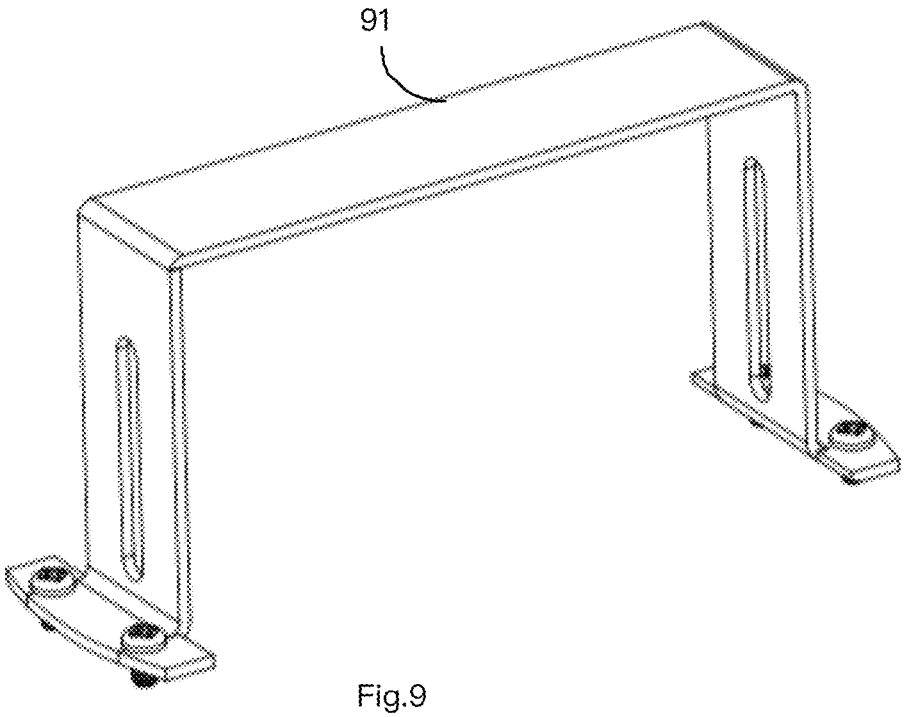
FIG. 9 is a connector embodiment.
Figure 10:
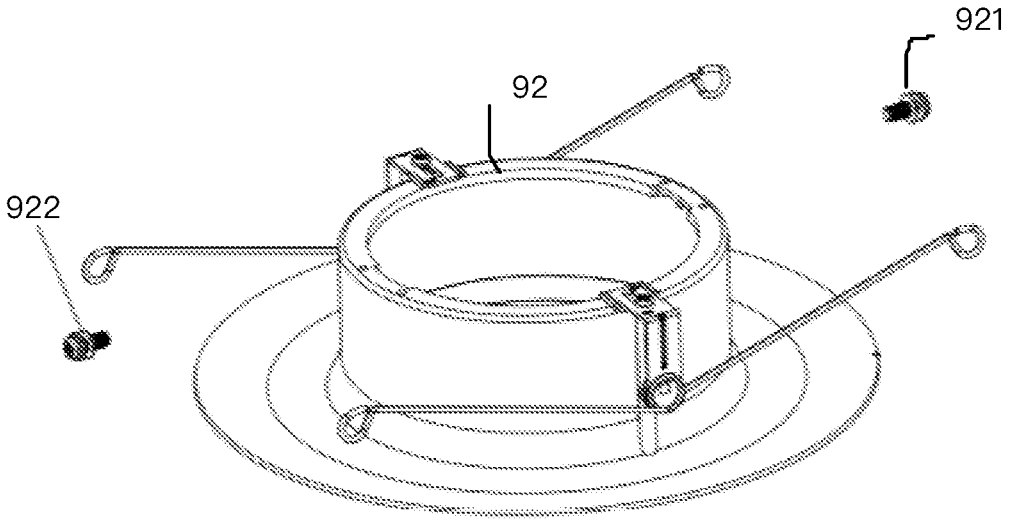
FIG. 10 is a base part embodiment.
Figure 11:
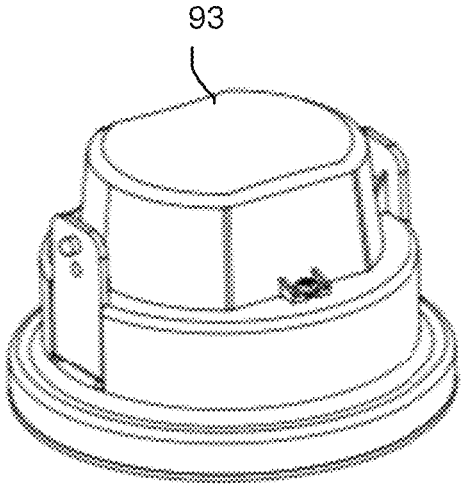
FIG. 11 is a major part embodiment.

FIG. 9, FIG. 10 and FIG. 11 illustrate a major part 93, a connector 91 and a base part 92 embodiment, that may form the embodiment of FIG. 7A and FIG. 7B. The connector 91 has an inverted U shape structure that may be made of metal. Two grooves are provided in the two side bars of the connector 91 for fitting the fastener units 921, 922 to keep the major part 81 and the base part 92 to remain or adjust their relative position.

In addition to the above-described embodiments, various modifications may be made, and as long as it is within the spirit of the same invention, the various designs that can be made by those skilled in the art are belong to the scope of the present invention.

The invention claimed is:

1. A downlight apparatus for being installed in a cavity, comprising:

a base part to be fixed in the cavity, the base part having a base housing for defining a through hole, and a light window;

a major part comprising a major housing and wherein a light is emitted passing through the light window; and a connector for connecting the major housing and the base housing, the connector providing multiple candidate positions along an extending direction of the through hole for a user to configure to change a vertical relative position of the base part and the major part so as to change an output light defined determined by the light window, wherein the connector comprises a groove disposed on the base part, a fastener disposed on the major part, the relative position of the fastener to the groove is adjustable when applying an external force.

2. The downlight apparatus of claim 1, wherein the connector has an inverted U structure with a side bar with the groove for connecting to the fastener.

3. The downlight apparatus of claim 2, wherein the track is built together with the major housing as a single unit.

4. The downlight apparatus of claim 1, wherein the connector transmits heat of the major part to the base part.

5. The downlight apparatus of claim 1, wherein an output beam angle of the output light is changed by adjusting the relative position.

6. The downlight apparatus of claim 1, wherein adjustment of the relative position between the major part and the base part involves more than one dimension.

7. The downlight apparatus of claim 6, wherein the track has two grooves for connecting to the fastener.

8. The downlight apparatus of claim 1, wherein the connector comprises a first screw unit in the base part and a second screw unit in the major part, when the first screw unit is rotated with respect to the second screw unit, the relative position between the base part and the major part is adjusted.

9. The downlight apparatus of claim 1, wherein the adjustment of the relative position between the major part and the base part changes an overall height of the downlight apparatus.

10. The downlight apparatus of claim 9, wherein the overall height of the downlight apparatus is adjustable to fit different standard heights for different countries.

* * * * *